United States Patent [19]

Lingstaedt et al.

[11] 4,232,261

[45] Nov. 4, 1980

[54] MOS CONTROL CIRCUIT FOR INTEGRATED CIRCUITS

[75] Inventors: Ernst Lingstaedt, Munich; Gerhard Moegen, Baldham; Gottfried Wotruba, Poing, all of Fed. Rep. of Germany

[73] Assignee: Eurosil GmbH, Munich, Fed. Rep. of Germany

[21] Appl. No.: 873,359

[22] Filed: Jan. 30, 1978

[30] Foreign Application Priority Data

Feb. 24, 1977 [DE] Fed. Rep. of Germany ..... 2708021

[51] Int. Cl.[3] ..... G05F 1/56

[52] U.S. Cl. ..... 323/22 R; 331/111; 331/186

[58] Field of Search ..... 307/296 R, 297, 304; 323/16, 20, 22 R, 22 T; 331/186

[56] References Cited

U.S. PATENT DOCUMENTS

| | | | |
|---|---|---|---|
| 3,743,923 | 7/1973 | Steudel | 323/22 R |
| 3,914,685 | 10/1975 | Gilder | 323/20 |
| 3,984,761 | 10/1976 | Edington et al. | 323/22 T |
| 4,068,134 | 1/1978 | Tobey et al. | 323/22 T |

*Primary Examiner*—A. D. Pellinen
*Attorney, Agent, or Firm*—Alvin E. Hendricson

[57] ABSTRACT

A circuit arrangement includes a MOS field effect transistor as a variable resistance in series with a load such as an integrated circuit across a power supply with means for controlling the variable resistance to establish a very constant supply or input voltage to the load. A switch may be included to apply a constant supply or input voltage of different known values to a load such as an oscillator requiring different voltages at different stages of operation.

12 Claims, 4 Drawing Figures

MOS CONTROL CIRCUIT FOR INTEGRATED CIRCUITS

BACKGROUND OF INVENTION

Many applications of integrated circuits provide for the use of batteries as a source of current and consequently these circuits must be designed to operate with a very small current consumption. CMOS technology has been found to be highly advantageous for low current applications, particularly as compared to other available technologies. Digital CMOS circuits have a very low power consumption or power loss inasmuch as every logic circuit condition of a logic stage of one of the current branches complimentary to the other is always blocked and consequently no conductive connection exists in the entire integrated circuit between the terminals of the power supply. Power loss does result in this type of circuit during dynamic operation owing to the shift of parasitic circuit capacities. During actual shift operations a momentary conductive connection is established across the power supply as long as the N-type transistors and P-type transistors are jointly conductive. What is commonly termed a reactive current flows during the aboved noted condition. Additionally, circuit components which may be included in CMOS circuits may cause a reactive current to circulate as a holding current because of working point adjustments, and this also contributes to power loss of the circuit.

One manner of evaluating CMOS circuits, as well as integrated circuits employing other technologies is the amount of current consumption required by the circuit. One manner of minimizing current consumption in CMOS circuits is to match the total absolute value of the threshold voltage of complimentary transistors to the supply voltage. In the foregoing manner, the reactive current may be minimized because the two complimentary and series connected transistors are operated in the lowest range of their conductivity. There are, however, certain practical difficulties in the foregoing because of unavoidable production tolerances or variations of threshold voltages and the fact that the supply voltage of batteries employed as a source of current is subject to substantial fluctuations. On the other hand, if CMOS circuits are designed to operate with transistor threshold voltages as high as possible and a supply voltage as low as possible, the current drawn may actually amount to a multiple of the possible desired minimum current.

Because of the aforementioned unavoidable variations in threshold voltages and fluctuations of supply voltage, there may be relatively wide variations of other circuit parameters. One such parameter, for instance, is the output current of a CMOS circuit that may be employed for the control of a following circuit stage. Consequently, it is quite difficult to construct monostable or bistable circuits which exhibit exact predetermined stable circuit conditions because the switching times depend in good part upon the threshold voltages and supply voltages.

The present invention is particularly directed to the control of the supply or input voltage for integrated circuits to achieve a maximum functional safety and an independence from fluctuations of threshold voltage or supply voltage.

SUMMARY OF INVENTION

The present invention provides a solution of the above-noted problems by a circuit arrangement including a controllable or variable resistance in the form of an MOS field effect transistor which is controlled by the output of a differential amplifier. A first reference voltage source is connected between one input of the differential amplifier and a power supply terminal, and a second reference voltage source is connected between the other input of the differential amplifier and a common connection of the controlable resistance and a load which are, in turn, connected in series across the supply voltage or power supply terminals.

The present invention is particularly useful in providing a supply voltage for an integrated circuit by employing an MOS field effect transistor operating as a controlable resistance and controlling the resistance thereof by means of a differential amplifier to substantially balance out power supply fluctuations or variations of varying degrees or effect which would otherwise bring about a change of the supply or input voltage establishing the flow or current in the integrated circuit. Although the present invention employs a known principal of control or adjustment, the invention differs from the prior art by employing two reference voltages. The foregoing is advantageous in the adjustment or control of the supply voltage of battery-operated integrated circuits inasmuch as such circuits generally operate with a relatively low supply voltage. Under circumstances wherein a high utilization rate of a battery power supply is required, prior art systems often suffer from the difficulty that the difference between the uncontrolled battery power supply and the controlled supply voltage is very small. Differential amplifiers of conventional design feed back the controlled output voltage directly to one of the differential amplifier inputs. If the difference between the uncontrolled power supply voltage and the controlled supply of voltage to the circuit is small, the input voltages of the differential amplifier are almost the same as the potential of one of the terminals of the power supply. The foregoing may result in the control voltages lying in a zone where the differential amplifier cannot be controlled owing to blocked input transistors therein. The present invention avoids or overcomes the foregoing difficulty by the provision of a second reference voltage. The second reference voltage is proportioned to the controlled supply voltage and is inserted in the connection to one of the differential amplifier inputs, so that a total voltage difference input occurs. In this manner, voltages always appear at both inputs of the differential amplifier in all conditions within the control range thereof.

The circuit arrangement according to the present invention simplifies the production of a regulated supply of voltages for MOS circuits corresponding to the total of the absolute value of the threshold voltages of the complimentary transistors in a CMOS circuit. This is accomplished by proportioning the first and second reference voltages according to the threshold voltages of the MOS field effect transistors of opposite conductivity type in the circuit to be supplied by the present invention.

A further advantage of the present invention lies in the production of a first reference voltage by an integrated CMOS reference voltage generator with the output voltage thereof comprising the control voltage for a constant source of voltage establishing a current for the second reference voltage. In this manner, the expense of a second reference voltage generator is precluded and there is only required an increased voltage input for the generation of the first reference voltage with a high constant value. This reference voltage is utilized on one hand for the control of a differential amplifier and on the other hand, for adjustment of the working point of a constant voltage source, so that the second reference voltage produced thereby corresponds substantially to the first reference voltage as regards constant value.

A circuit arrangement according to the present invention is particularly adapted for the supply of oscillator circuits owing to the adjustable characteristics and the very constant value of supply voltage produced. Crystal-controlled oscillators, in particular, require increased power during build-up of oscillations as compared to the power required during the condition of constant oscillation and thus an increased supply voltage is necessary during oscillation build-up. To accomplish the foregoing, a circuit arrangement in accordance with the present invention may incorporate a time switch, or the like, for setting of the controlled supply voltage to produce an increased voltage during the build-up period of the oscillation circuit and a subsequent predetermined constant regulated supply of voltage delayed a predetermined period of time after initiation of operation. The above-noted time switch can be employed to produce a signal by means of a change in voltage of an RC circuit which effects the value of the regulated supply voltage, as set forth in more detail below. It is also possible, in accordance with the present invention, to control the amplitude of regulated voltage from a signal obtained from the oscillator circuit, with such signal being proportioned to the vibrational amplitude of oscillations. Such a signal is employed to influence a control circuit of the present invention during build-up of oscillation to terminate this influence when the vibrational amplitude of the oscillated circuit attains a predetermined value. A circuit arrangement acccording to the present invention requires an extremely constant reference voltage for faultless control. For the generation of the reference voltage, a circuit is required which has a low current consumption within the meaning of the intended application of the present invention. It is advantageous to form a circuit arrangement according to the present invention in such a manner that at least one of the reference voltages is generated by a stabilization stage having a current branch connected to the supply voltage by means of a MOS field effect transistor. This transistor is operated in saturation with a series resistance so that a stabilized voltage may be tapped off of the MOS field effect transistor. At least one more stabilization stage of this type is also provided with the series resistance thereof being formed by an MOS field effect transistor which is connected with an ohmic resistance in opposed current coupling and is controlled by the stabilized voltage. This latter MOS field effect transistor is complimentary to the serially connected MOS field effect transistor and in accordance with this arrangement, further stabilization stages may be series connected so that the actual output voltage thereof is the control voltage of the following stage. It will thus be seen that the present invention provides a further improvement in the generation of a constant voltage, particularly with regard to the production of a stable input voltage for integrated circuits.

An additional and important application of the present invention lies in the control of the input voltage for an integrated RC oscillator circuit. The present invention produces an input or supply voltage for an integrated circuit that is so constant that the frequency regulation or constancy of frequency of conventional RC oscillator circuits may be considerably improved by the utilization of the present invention. An even further improvement in the maintenance of a constant frequency of an RC oscillator circuit may be attained in accordance with the present invention by employing two MOS inverter stages connected in parallel to the input voltage and jointly connected by a RC arrangement to the oscillatory circuit. The foregoing additional improvement comprises an extension of the basic concept of the present invention applied to maintaining a constant frequency oscillator output, inasmuch as successive portions are formed from series connected MOS field effect transistors and ohmic resistances.

DESCRIPTION OF FIGURES

The present invention is illustrated as to particular preferred embodiments thereof in the accompanying drawings, wherein.

DESCRIPTION OF PREFERRED EMBODIMENTS

Figure 1:
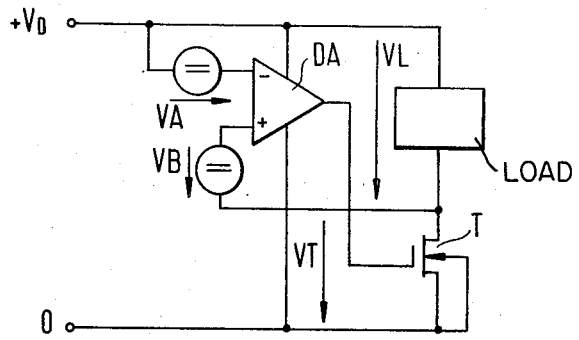
FIG. 1 is a basic circuit diagram of a circuit arrangement in accordance with the present invention.

Referring to FIG. 1 of the drawings, there will be seen to be shown an integrated circuit L adapted to be supplied with an input supply voltage VL, connected in series with an MOS field effect transistor T across the terminals of a power supply producing an unregulated power supply or supply voltage $V_D$. The power supply voltage $V_D$ may be provided by a battery or the like, connected between ground, which is indicated as zero potential connected to the transistor T, and the $+V_D$ terminal connected to the load or integrated circuit L. The gate of the MOS field effect transistor T is connected to the output of a differential amplifier DA. This differential amplifier DA is energized by the power supply voltage $V_D$ and $+V_D$ is connected through a voltage source VA to the inverting input of the differential amplifier. The non-inverting input of the differential amplifier is connected through a voltage source VB to the junction of the integrated circuit L and the transistor T. It will thus be seen that there is applied to the non-inverting input of the differential amplifier a total of the voltages VB and a voltage VT which is the cut-off voltage of the MOS field effect transistor T. The composition of the voltage sources VA and VB is described below, hoever, it is sufficient to note at the present time that these voltages are applied to the inputs of the differential amplifier.

It will be seen that a controlled voltage appears at the connection of the integrated circuit L and the MOS field effect transistor T, and furthermore, that this controlled voltage is connected through the opposing voltage VB to the non-inverting input of the differential amplifier. The differential amplifier amplifies the voltage difference occurring between the inputs thereof and the output of the differential amplifier controls the MOS field effect transistor T in such a manner that the voltage difference between input of the differential amplifier DA tends to disappear. A controlled input voltage VL is thus established for the integrated circuit L, with such voltage VL corresponding to the total of the two reference voltages VA and VB, which is consequently very constant inasmuch as the reference voltages VA and VB are in themselves constant voltages. The voltage VT across the transistor T comprises the difference in voltage between $V_D$ and VL.

It will be appreciated that the signal applied to the non-inverting input of the differential amplifier DA is always the sum of the voltages VB and VT and thus even for very low values of the voltage VT, there is provided a sufficient difference of input signals to the differential amplifier to guarantee operation thereof in the control range of the amplifier.

Implementation of the present invention in CMOS (complimentary MOS field effect circuitry) may be advantageously accomplished for particularly low current consumption by supplying the integrated circuit L with a controlled or supply voltage input VL which corresponds to the total of the threshold voltages of the circuit MOS field effect transistors of opposite types of conductivity. It is possible, and in fact, quite simple by employing CMOS techniques, to proportion the reference voltages VA and VB in such a way that voltage VA, for example, corresponds to the threshold voltage of P channel transistors and the reference voltage VB to the threshold voltage of N channel transistors in a CMOS circuit.

Figure 2:
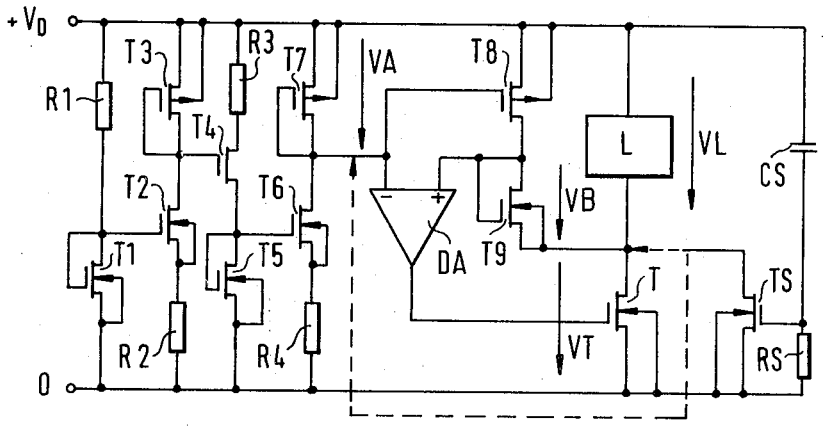
FIG. 2 is a circuit diagram of the circuit of FIG. 1 with implementation of the reference voltages in CMOS.

In FIG. 2 of the drawings, there is illustrated one advantageous manner of providing the two reference voltages VA and VB in a CMOS configuration. The reference voltage VA is produced as a highly constant output voltage of a reference voltage generator which includes MOS field effect transistors T1 to T7, and which is connected to the inverting input of the differential amplifier DA. The reference voltage VA is also employed to control a constant voltage source comprising two MOS field effect transistors T8 and T9 having the constant voltage output thereof connected as the second reference voltage VB to the non-inverting input of the differential amplifier DA.

Referring now more specifically to FIG. 2, it will be seen that the reference voltage generator consist of four current branches, of which the first contains an MOS field effect transistor T1, operated in saturation and connected in series with an ohmic resistance R1 between $+V_D$ and ground. A second parallel current branch includes an ohmic resistor R2 connected in series with series connected MOS field effect transistors T2 and T3 across the power supply $V_D$. The transistor T2 is controlled by connection of the gate thereof to the junction of T1 and R1, so as to be controlled by the threshold voltage of T1. The transistor T3 is operated in the saturation region, and the transistor T2 is operated in current reverse coupling with the resistance R2. A third current branch is formed by the series connected resistance R3 and transistors T4 and T5, in reverse current arrangement to the second branch and the transistor T4 is controlled by the threshold voltage of transistor T3 through connection of the gate of transistor T4 to the junction of transistors T2 and T3. A fourth current branch is formed by a resistor R4 and transistors T6 and T7 connected for current flow in the opposite direction from the third branch and having the transistor T6 controlled by the threshold voltage of transistor T5 through connection of the gate of T6 to the junction of transistors T4 and T5. The output voltage VA of the foregoing circuitry including transistors T1 through T7, appears at the junction of transistors T6 and T7, and this highly regulated voltage of very constant value is applied to the inverting input of the differential amplifier DA.

It will be appreciated that the manner of voltage regulation of the circuit including transistors T1 through T7 is basically the same as that described in detail with regard to the circuit of FIG. 1. It is to be particularly noted that the circuit, just described, is highly advantageous when constructed in CMOS, in that the individual branch currents are extremely low and that the output voltage VA corresponds to the threshold voltage of the N channel field effect transistor T7 which is operated in the saturation zone.

The reference voltage generator described above and illustrated in FIG. 2 is susceptible to various modifications and may, for example, contain more or less current branches for stabilization. It is also possible to relate the reference voltage output to ground or zero potential rather than to $+V_D$ by taking the output voltage from an MOS field effect transistor operated in saturation and connected to zero potential. Thus, for example, in FIG. 2, the output could be taken from transistor T5 to relate the output to zero potential.

The reference voltage VA which is applied to the inverting input of the differential amplifier DA is also applied to the gate of a transistor T8 connected to $+V_D$ and connected in series with a transistor T9 operated in the saturation region. This series connection forms a constant voltage source providing a constant voltage VB at transistor T9, because of the control by the constant reference voltage VA. This voltage VB is connected to the non-inverting input of the differential amplifier DA.

The arrangement of FIG. 2 described above is advantageous in reducing the circuit complexity for obtaining the two reference voltages employed in the present invention. The second reference voltage VB is generated without the necessity of duplicating the circuitry for generating the first reference voltage VA.

If the integrated circuit L, shown to be connected in series with the transistor T across the power supply, comprises an oscillator circuit containing inductive and compacitive components controlled by a crystal, for example, it is necessary to provide an increased amount of energy to the circuit at the time the power supply is switched on in order to build up oscillations in the circuit. Inasmuch as the controlled voltage VL has a relatively low value, which in CMOS circuits corresponds to the total of the threshold voltages of the P-channel and N-channel transistors, and inasmuch as most complimentary circuit oscillators have a relatively low degree of amplification at this operating condition, it is not always possible to insure a reliable start of the oscillator circuit. Appropriate higher amplification of a complimentary oscillator circuit or stage, and thus the capability of a reliable start-up after switching on the power supply, can be achieved if the supply voltage for the oscillator circuit is higher than the total of the threshold voltages of the MOS field effect transistors of both types of conductivity in the oscillator circuit. On the other hand, it is possible to reduce the supply of voltage of an oscillator circuit in the steady state condition of oscillation, inasmuch as only enough energy is then required to sustain oscillations.

A circuit embodying the present invention for the supply of a regulated voltage to an oscillator circuit should incorporate a control characteristic for applying a higher supply of voltage to the oscillator when the power supply $V_D$ is switched on and then reducing the controlled voltage VL when the oscillator reaches steady state oscillation. In FIG. 2 there is shown arrangements for accomplishing this control or switching. Referring again to FIG. 2, there will be seen to be provided a series connection of a capacitor CS and resistor RS connected across the integrated circuit L and transistor T and thus across the power supply $V_D$. When the power supply is connected or turned on, a voltage will appear at the connection of the capacitor CS and resistor RS with the value of this voltage decreasing as the condenser charges from the power supply voltage $V_D$ to a value determined by the value of the two components of the RC circuit and with a time constant also determined by the value of these two components. This voltage is employed to control a further MOS field effect transistor TS by connecting the gate of this transistor to the junction of the capacitor and resistor. The switching transistor TS may be connected either in parallel with the transistor T or in parallel with the transistor T6 in series with the reverse coupling resistance R4. These two possible connections are illustrated in FIG. 2 by dashed lines.

Considering first the embodiment of the present invention wherein the switching transistor TS is connected in parallel with the transistor T, it is noted that the voltage on the gate of transistor TS initially causes a substantial short circuit to exist series with the oscillator L across the power supply, so that almost the full power supply voltage $V_D$ appears across the oscillator. Progressive charging of the capacitor CS through the resistance RS reduces the gate voltage on the switching transistor TS so that this transistor is cut off and the above-noted short circuit is eliminated. The transistor T is then effectively reinserted in the circuit to operate as a controlled series resistance with the circuit L so that only the controlled input or supply voltage VL appears across the circuit L.

The alternative embodiment in FIG. 2 wherein the switching transistor TS is connected across transistor T6 and resistor R4 of the reference voltage source applies the time dependent signal at the junction of capacitor CS and resistor RS to influence the reference voltage VA. During the charging process of the capacitor CS, the MOS field effect transistor TS is maintained in a conducting or substantially short circuited condition whereby the current flowing through transistor T7 of the reference voltage generator is increased. Consequently, a higher reference voltage VA appears at the output of transistor T7 so that the supply voltage VL of the integrated circuit L is adjusted or maintained at a higher value. As the capacitor CS charges to a sufficient value, the transistor TS is cut off so that the above-noted operation upon the output circuit of the reference voltage generator terminates and the normal comparatively low supply voltage VL then appears across the oscillator circuit L being supplied thereby.

It will be appreciated that the above described temporary increase of the supply voltage for the circuit L has a duration depending upon the values of the components of the RC circuit comprised of capacitor CS and the resistor RS. While this manner of controlling or switching the supply voltage for the integrated circuit L is advantageous, it is also possible to control the duration of the increased supply voltage in other manners related to the build-up of oscillations in the oscillator L. Thus, for example, a saw tooth voltage may be generated for influencing the control of the supply voltage applied to the circuit L so as to produce a result similar to that available from the circuit illustrated in FIG. 2. Such a saw tooth or sweep voltage is initiated by switching on or connecting the power supply $V_D$ to an appropriate generator which then causes the desired increase of the supply voltage to the circuit L in one of the manners described above, for example. By properly relating the rate of change of the saw tooth or sweep voltage to the rate of built-up of oscillations in the circuit L, this voltage will reach an appropriate level to terminate influence on the control of the voltage supplied to circuit L when the oscillations therein have built up to a sufficient amplitude that a lower supply voltage is adequate. It is also possible to control or establish the above-noted temporary increase of the supply voltage by a signal taken directly from the oscillator itself and which signal has a value in proportion to the respective oscillation amplitude. A suitable circuit for carrying out this embodiment of the present invention is illustrated in FIG. 3, wherein the invention is shown to supply a voltage VL to an oscillator circuit OSC.

Figure 3:
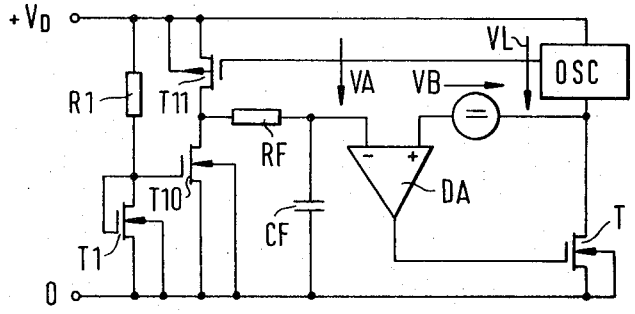
FIG. 3 is a circuit diagram of the present invention as applied to the control of input voltage for an oscillator circuit.

Referring to FIG. 3, there will be seen to be provided a simplified reference voltage generator, as compared to the circuit of FIG. 2, wherein only a single stabilization current branch is employed. This branch comprises an ohmic resistance R1 in series with a transistor T1 operating in the saturation region in common with the circuit of FIG. 2. The voltage appearing across this transistor T1 is employed to control another MOS field effect transistor T10 which is connected in series with a like transistor T11 across the power supply as a further current branch of the reference voltage generator. The voltage across transistor T1 is substantially constant despite variations of the supply voltage $V_D$ and is applied to the gate of transistor T10 so as to establish a substantial current flow through the current branch of transistors T10 and T11. The voltage appearing at the junction of transistor T10 and T11 is applied to the inverting input of the differential amplifier DA. In FIG. 3, the reference voltage source VB is shown only diagrammatically inasmuch as this portion of the circuit has no effect on the control of the first reference voltage VA during build-up of oscillations in the oscillator circuit OSC.

The MOS field effect transistor T11 is controlled by the application to the gate thereof of a signal from the oscillator circuit OSC which has a voltage value proportional to the amplitude of oscillations produced by the circuit OSC. When the oscillator circuit OSC is not oscillating, the control signal applied to transistor T11 comprises a DC voltage which may correspond to about one-half of the supply voltage VL normally applied to the oscillator. This voltage controls CMOS field effect transistor T11 in such a manner that it develops a comparatively high voltage thereacross which is conveyed as a reference voltage VA to the inverting input of the differential amplifier DA which produces an output that controls the transistor T so as to cause this transistor to be highly conductive. The foregoing condition causes a comparatively high supply voltage VL to be applied to the oscillator circuit OSC. When the oscillations of the oscillator circuit OSC are initiated, an alternating voltage is superimposed upon the above-noted direct current voltage which controls the transistor T11, and this alternating voltage is rectified by the non-linear characteristics of the transistor T11. The rectified voltage superimposed upon the direct current voltage at the gate electrode of the transistor T11 causes this transistor to develop a voltage thereacross which is small compared to the above described voltage. As previously described, the controlled supply voltage VL applied to the oscillator OSC is consequently reduced to normal low value.

The circuit of FIG. 3 includes, in addition to the aforementioned elements, a capacitor CF connected between the output of transistor T and the inverting input of the differential amplifier DA and a resistor RF connected between the connection of transistor T10 and T11, and the inverting input of the differential amplifier. These elements CF and RF comprise a low-pass filter so connected that only the mean direct current voltage formed by the described superimposition of AC and DC voltages is conveyed to the inverting input of the differential amplifier VA so that high frequency voltages produced by the oscillator OSC are prevented from influencing the differential amplifier.

One advantageous aspect of the circuit of FIG. 3 is the compensation of the amplitude of oscillation of the circuit OSC. The control signal which is proportional to the vibrational or oscillatory amplitude of the circuit OSC, and which is applied to the transistor T11 controls the resistance of this transistor in such a manner that an increase of the oscillatory amplitude causes a reduction of the supply voltage VL, and a decrease of the oscillatory amplitude causes an increase of the supply voltage VL. In this manner, the circuit of FIG. 3 not only provides for supplying an input voltage to the integrated oscillator circuit OSC in such a manner as to minimize current consumption, but in addition, establishes a constant amplitude of oscillation of signals produced by the circuit OSC.

Inasmuch as a circuit arrangement according to the present invention provides a highly constant supply voltage for integrated circuits as a result of the particular advantageous control characteristics of the present invention, it is also possible to advantageously utilize this invention for the regulation of supply or input voltage for RC oscillator circuits. It is possible to fabricate RC oscillator circuits in integrated CMOS technology, however, such circuits normally have a lesser constancy of frequency than crystal controlled circuits, and this generally results from variations in supply voltage. RC oscillator circuits formed as integrated circuits exhibit a dependency of the oscillatory frequency upon fluctuations in supply voltages and ambient temperatures by a factor of 1000 or more as compared to corresponding crystal controlled oscillator circuits. Unfortunately, normal integrated circuit RC oscillators have substantial frequency variations that may extend into the percentage range. Additionally, conventional circuits of this type have the disadvantage that they require relatively high supply voltage.

Figure 4:
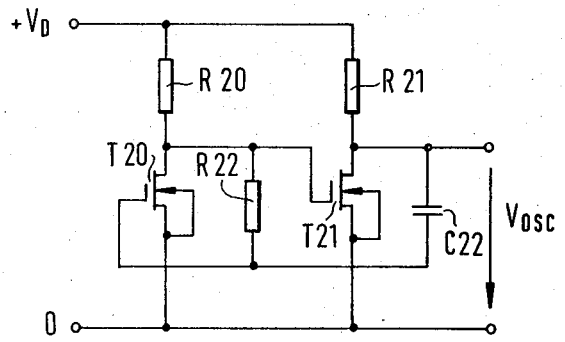
FIG. 4 is a circuit diagram of an RC oscillator circuit having the operating voltage controlled in accordance with the present invention.

The present invention provides a material improvement of integrated circuit RC oscillators and in FIG. 4 there is illustrated an RC oscillator adapted for integrated circuit fabrication employing MOS technology in accordance with the present invention. This circuit of FIG. 4 employs the present invention to apply a regulated supply or input voltage to the oscillator with such voltage having a very constant value so that the frequency variations due to supply voltage variations are substantially precluded. Contrary to prior art RC oscillator circuits which have been constructed in CMOS techniques, the circuit of FIG. 4 contains only two MOS field effect transistors rather than four of such transistors. This, in itself, comprises a material advancement in the art. The circuit of FIG. 4 will be seen to essentially comprise two inverter stages including transistors T20 and T21 and resistors R20 and R21, respectively. More specifically, FIG. 4 illustrates a series connection of resistor R20 and transistor T20 in series across the power supply $V_D$ and a parallel connection across this power supply comprising resistor R21 and transistor T21. The oscillating output voltage $V_{OSC}$ is derived across transistor T21 and this voltage is coupled through a capacitor C22 to the gate electrode of the MOS field effect transistor T20. The drain electrode of the transistor T20 is connected to the gate electrode of the transistor T21 and a coupling resistor R22 is connected between the drain electrode of transistor T20 and the gate electrode of the same transistor.

The circuit of FIG. 4 is readily integratable and does not require a quartz crystal control. The degree of control of frequency by the present invention is very considerably improved over prior art circuits of this general type, because of the highly constant supply voltage applied to the oscillator. It has been established that it is possible by appropriate choice of circuit components providing a supply voltage corresponding to about twice the value of a threshold voltages of two N-channel transistors T20 and T21 to produce only a frequency change of about 0.1 percent oscillation amplitude with a threshold voltage variation of 20 MV for a power supply voltage of 1.2 volts. It will be appreciated that this comprises a material advancement in the art.

In the above described circuits of the present invention, it is possible to provide substrate connections of the MOS field effect transistors to the respective source contact. Consequently, the substrate control effect, as it is generally termed, is avoided by this invention. Additionally, it is possible to provide alternative potential connections to the substrate.

The above described circuits of the present invention, which are all adapted for fabrication in integrated CMOS, may also be arranged for operation with the opposite pole of the supply voltage $V_D$. It will be appreciated that opposite polarity operation requires corresponding inverse construction of the complimentary circuit branches.

There has been described above, various embodiments and applications of the present invention, however, it will be appreciated by those skilled in the art, that numerous modifications and variations in the illustrations and descriptions may be employed within the true spirit of the present invention. It is consequently not intended to limit the present invention to the precise details of illustration nor terms of description.

What is claimed is:

1. An integrated CMOS circuit for controlling input voltage to an integrated CMOS load so as to have a value of a reference voltage including a MOS field-effect control transistor connected in series with said load across a power supply and a differential amplifier having an output connected to the gate of said control transistor, characterized by a first and a second reference voltage source defining together said reference voltage and being connected in series with the voltage between inputs of said differential amplifier and with said load in a closed loop connection whereby said input voltage to said load is dependent upon the sum of said reference voltages, said reference voltages corresponding to the threshold voltages of MOS field-effect transistors in said integrated CMOS load, and said reference voltage sources including saturated MOS field-effect transistors which are complementary to each other.

2. The circuit of claim 1 further defined by said integrated circuit load including complimentary P-channel and N-channel MOS field effect transistors and said first and second reference voltage sources producing constant output voltages substantially equal to the separate threshold voltages of said complimentary load transistors.

3. The circuit of claim 1 further defined by said first reference voltage source comprising a constant voltage multibranch CMOS circuit with the constant voltage output being connected to control the voltage output of a pair of MOS field effect transistors comprising said second reference voltage source.

4. The circuit of claim 3 further defined by said second reference voltage source having said transistors comprised as CMOS transistors connected across said load to thus place the transistors in series with said control transistor across said power supply, and a first of the transistors of said second voltage source being operated in the saturation region thereof with the output of said second voltage source being connected from the junction of the last stated transistors to the other input of said differential amplifier.

5. The circuit of claim 1 adapted to control the input voltage of an oscillator comprising said integrated circuit load and further comprising a timing circuit including an RC circuit and a switching transistor controlled by said RC circuit for bypassing a portion of said control circuit during a period of oscillation build-up for applying substantially the voltage of said power supply to said oscillator during such period and switching to to apply controlled input voltage to said oscillator after oscillation build-up.

6. The circuit of claim 5 further defined by said RC circuit including a resistor and capacitor connected in series across said power supply and means connecting the junction of said resistor and capacitor to a gate electrode of said switching transistor for controlling the conduction thereof.

7. The circuit of claim 5 further defined by said switching transistor being connected in parallel with said control transistor.

8. The circuit of claim 5 further defined by said switching transistor being connected to the output of said first reference voltage source.

9. The circuit of claim 5 further defined by means coupling a signal from said oscillator that is proportion to the amplitude of oscillations thereof to the gate of a MOS field-effect transistor in the output of said first reference voltage source.

10. The circuit of claim 9 further defined by a low pass filter connecting said first reference voltage source to an input of said differential amplifier.

11. The circuit of claim 5 further defined by said timing circuit comprising a bistable circuit which increases input voltage to said oscillator for low amplitude of oscillations thereof and decreases input voltage to said oscillator for high amplitude of oscillations thereof to thus regulate oscillation amplitude.

12. The circuit of claim 1 further defined by said first reference voltage source including a first branch having a resistor and MOS field effect transistor operating in saturation connected in series across said power supply, a second branch including a series connection of complimentary MOS field effect transistors and a resistor connected across said power supply, and a connection from the junction of the resistor and transistor of said first branch to a gate electrode of the second branch transistor connected to the second branch resistor for stabilizing an output voltage at a junction of said complimentary transistors in said second branch.

* * * * *